US005165476A

United States Patent [19]

Jones

[11] Patent Number: 5,165,476

[45] Date of Patent: Nov. 24, 1992

[54] GRAVEL PACKING OF WELLS WITH FLOW-RESTRICTED SCREEN

[75] Inventor: Lloyd G. Jones, Dallas, Tex.

[73] Assignee: Mobil Oil Corporation, Fairfax, Va.

[21] Appl. No.: 713,222

[22] Filed: Jun. 11, 1991

[51] Int. Cl.[5] ..... E21B 43/04

[52] U.S. Cl. ..... 166/278; 166/51; 166/227; 166/242

[58] Field of Search ..... 166/278, 276, 51, 115, 166/116, 191, 242, 227, 228, 229, 235, 236

[56] References Cited

U.S. PATENT DOCUMENTS

| | | | |
|---|---|---|---|
| 3,768,563 | 10/1973 | Blount | 166/291 |
| 4,202,411 | 5/1980 | Sharp et al. | 166/296 X |
| 4,239,084 | 12/1980 | Sharp et al. | 166/278 |
| 4,487,259 | 12/1984 | McMichael, Jr. | 166/236 X |
| 4,621,692 | 11/1986 | Mondshine | 166/278 X |
| 4,945,991 | 8/1990 | Jones | 166/278 |

*Primary Examiner*—Terry Lee Melius
*Attorney, Agent, or Firm*—Alexander J. McKillop; Charles J. Speciale; George W. Hager, Jr.

[57] ABSTRACT

A method and apparatus for gravel packing an interval of a wellbore wherein a permeable screen having a means for restricting fluid flow from the annulus into the upper portions of the screen is positioned adjacent the wellbore interval. The flow-restrictive means may be comprised of any material which remains substantially solid during circulation of the gravel slurry but preferably is a material that can be removed, e.g. by melting or dissolving, after the gravel has been placed. Examples of such material are (1) blends of waxes; (2) eutectic compounds formed by combining organic compounds; (3) salts; and (4) asphaltenes which are soluble in crude oil. The flow-restrictive means also may be formed of a perforated metal sleeve which is dissolvable by acid.

8 Claims, 1 Drawing Sheet

GRAVEL PACKING OF WELLS WITH FLOW-RESTRICTED SCREEN

DESCRIPTION

1. Technical Field

The present invention relates to the gravel packing of wells and in one aspect relates to the gravel packing of a well which utilizes a screen which is originally restricted to flow towards its upper end to prevent premature fluid loss thereby providing a good distribution of gravel throughout the packed interval of the wellbore.

2. Background

In producing hydrocarbons or the like from loosely or unconsolidated and/or fractured subterranean formations, it is not uncommon to produce large volumes of particulate material (e.g. sand) along with the formation fluids. These particulates routinely cause a variety of problems which result in added expense and substantial downtime. For example, in most instances, particulates in the produced fluids cause (1) severe errosion of the well tubing and other production equipment; (2) partial or complete clogging of the flow from the well which requires workover of the well; (3) caving in the formation and collapse of the well casing; (4) extra processing of the fluids at the surface to remove the particulates; and (5) extra cost in disposing of the particulates once they have been separated. Accordingly, it is extremely important to control the production of particulates in most operations.

Probably the most widely-used technique used to control the production of particulates (e.g. sand) from a well is known as gravel packing. In a typical gravel pack, a screen is lowered into the wellbore and positioned adjacent the interval of the well which is to be completed. Particulate material, collectively referred to as gravel, is then pumped as a slurry down the tubing on which the screen is suspended. The slurry exits the tubing above the screen through a "cross-over" or the like and flows downward in the annulus formed between the screen and the well casing or open hole, as the case may be. The liquid in the slurry flows into the formation and/or the openings in the screen which are sized to prevent the gravel from flowing therethrough. This results in the gravel being deposited or "screened out" in the annulus around the screen where it collects to form the gravel pack. The gravel is sized so that it forms a permeable mass around the screen which allows flow of the produced fluids therethrough and into the screen while blocking the flow any particulates produced with the formation fluids.

One of the major problems associated with gravel packing, especially where long or inclined intervals are to be completed, arises from the difficulty in distributing the gravel over the entire interval to be completed, i.e. completely packing the annulus between the screen and the casing in cased wells or between the screen and the wellbore in open hole or under-reamed completions. This poor distribution of gravel (i.e. incomplete packing of the interval) is often caused by the liquid in the gravel slurry flowing (1) into more permeable strata in the upper end of the formation interval and/or (2) through the openings in the upper portion of the screen before sufficient gravel has been transported to the bottom of the completion interval. This premature loss of liquid from the slurry causes the formation of gravel (e.g. sand) "bridges" in the annulus at the fluid loss location(s) which, in turn, block further flow of the slurry through the annulus thereby preventing the placement of sufficient gravel in the annulus below the bridge.

U.S. Pat. No. 4,945,991 and copending U.S. patent applications 07/848,061, filed Jan. 31, 1991 and 07/694,163, filed May 1, 1991 (all commonly assigned to the present Assignee) disclose methods for gravel packing an interval of a wellbore wherein good distribution of the gravel is provided throughout the desired interval even if sand bridges form before all the gravel is deposited. In this method, perforated shunts or conduits are provided along the external surface of the screen which are in fluid communication with the gravel slurry as it enters the annulus in the wellbore adjacent the screen. If a sand bridge forms before all of the gravel is placed, the slurry will flow through the conduits and out into the annulus through the perforations in the conduits to complete the filling of the annulus above and/or below the bridge. While this method is effective to bypass any bridges that may be formed during a gravel pack operation, it does not prevent the formation of such bridges where the liquid from the slurry is lost to the upper part of the gravel pack screen.

SUMMARY OF THE INVENTION

The present invention provides a method and apparatus for gravel packing an interval of a wellbore wherein the problems normally associated with premature liquid loss from the gravel slurry, i.e. formation of sand bridges in the annulus before all of the gravel has been distributed, is avoided. By substantially reducing premature liquid loss from the gravel slurry, there is a good distribution of gravel over the entire completion interval. In the present invention, a permeable screen is positioned within a wellbore adjacent the interval to be completed and a gravel slurry is flowed down the well and into the annulus between the screen and the wellbore. Flow from the annulus is restricted into the upper portions of the screen while the slurry is flowing through the annulus so that the slurry will flow to the bottom of the interval and deposit the gravel before any substantial fluid loss occurs.

More specifically, the present invention provides a method and apparatus for gravel packing an interval of a wellbore wherein a permeable screen having a means for restricting fluid flow from the annulus into the upper portions of the screen is positioned adjacent the wellbore interval. The flow-restrictive means may be comprised of any material which effectively blocks or partially blocks fluid flow through the otherwise permeable wall of the screen. In some applications where the permeable area of the screen is adequate to handle the flow of production/injection fluids, the flow-restrictive means may be left in tact during the operational life of the completion. Preferably, however, the flow-restrictive means is only temporary and is removable once the gravel pack has been completed so that full flow is restored through all portions of screen.

The flow-restrictive mean is comprised of a sleeve or the like of a material which remains substantially solid during circulation of the gravel slurry and is preferably one which will or can be melted or dissolved after the gravel has been placed throughout the completion interval. Examples of such materials include (1) blends of waxes which melt at a designed temperature, e.g. at or slightly greater than that of the temperature of the formation being completed; (2) eutectic compounds formed by combining organic compounds which also melt at similar designed temperatures; (3) salts which are soluble in particular solutions; and (4) asphaltenes which are soluble in crude oil.

Further, flow-restrictive means may be formed of a sleeve comprised of a metallic material, e.g. a soft or mild steel, which are dissolvable in acid solutions, e.g. hydrochloric acid. Since commercially-available screens are routinely made of stainless steel, the acid will dissolve a sleeve made of mild steel but will not do any substantial damage to the screen. The sleeve is perforated along at least a portion of its length with the perforations in the lower end of the sleeve being larger than the perforations at the upper end. This allows substantially unrestricted flow through the larger perforations while restricting flow through the smaller perforations.

In operation, the screen having the flow-restrictive means is lowered into wellbore and is positioned adjacent the interval to be completed. Gravel slurry is then flowed through the annulus around the screen. The flow-restrictive means restricts the flow of liquid from the slurry into the upper portion of screen so that there is little, if any, premature liquid loss to the upper portions of the screen, thereby reducing the possibility of sand bridges being formed in the annulus.

After the gravel has been deposited around the screen, the flow-restrictive means can be removed to re-establish fluid flow through substantially the full length of screen. Where the flow-restrictive means is comprised of a material which melts, it is removed by melting in situ or by circulating a heated fluid through the well. Where the means is comprised of a salt, an asphaltene, or a metal or other dissolvable material, an appropriate solvent solution is used to dissolve the flow-restrictive means.

BRIEF DESCRIPTION OF THE DRAWINGS

The actual construction, operation, and apparent advantages of the present invention will be better understood by referring to the drawings in which like numerals identify like parts and in which.

BEST MODE FOR CARRYING OUT THE INVENTION

Figure 1:
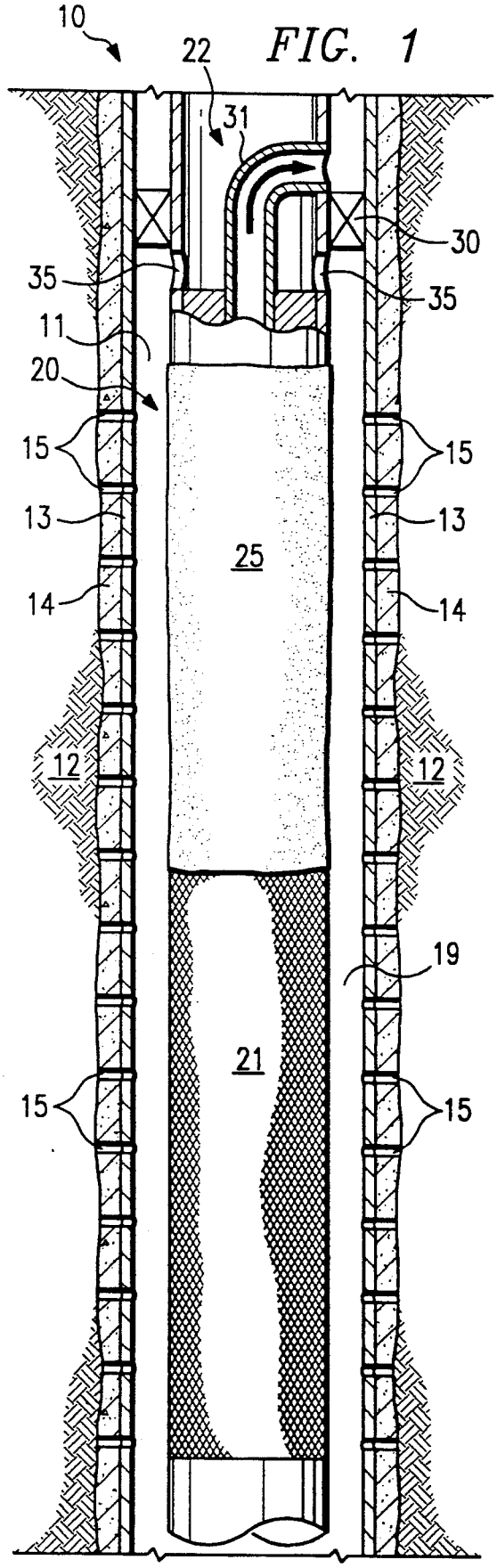
FIG. 1 is an elevational view, partly in section, of the present, gravel pack apparatus in an operable position within a wellbore.

Referring more particularly to the drawings, FIG. 1 illustrates the lower end of a producing and/or injection well 10. Well 10 has a wellbore 11 which extends from the surface (not shown) through an unconsolidated and/or fractured production and/or injection formation 12. As shown, wellbore 11 is cased with casing 13 and cement 14 having perforations 15 therethrough to establish fluid communication between formation 12 and the interior of casing 13. While the present invention is illustrated in a substantially vertical cased well 10, it should be recognized that the present invention could also be used in open-hole and/or underreamed completions as well as in horizontal and/or inclined wellbores, if the situation dictates.

Gravel pack apparatus 20 of the present invention is positioned within wellbore 11 adjacent the completion interval of formation 12 with annulus 19 being formed between the screen and the casing 13. Apparatus 20 is comprised of a sand screen 21 having a "cross-over" sub 22 connected to its upper end which, in turn, is suspended from the surface on a tubing or work string (not shown). The term "screen" is used generically herein and is meant to include and cover any and all types of permeable structures commonly used by the industry in gravel pack operations which permit flow of fluids therethrough while blocking the flow of particulates (e.g. commercially-available screens, slotted or perforated liners or pipes, screened pipes, prepacked screens and/or liners, or combinations thereof). Screen 21 can be of one continuous length or it may consist of sections (e.g. 30 foot sections) connected together by subs or blanks. An example of a typical sand screen which can be used in the present invention is disclosed in U.S. Pat. No. 4,664,191, issued on May 12, 1987 and is incorporated herein by reference.

The present invention provides a gravel pack completion which alleviates the problems normally associated with premature liquid loss from the gravel slurry during the placement of gravel around screen 21, i.e. formation of sand bridges in the annulus before all of the gravel has been distributed is avoided. By substantially reducing premature liquid loss from the gravel slurry, there is a good distribution of gravel over the entire completion interval.

In accordance with the present invention, screen 21 includes a means for restricting fluid flow from the annulus 19 into the upper portions of the screen during a gravel pack completion. By restricting fluid flow through the upper portions of the screen while allowing substantially unrestricted fluid flow through the lower portions thereof, no substantial amount of liquid from the gravel slurry is lost prematurely through the upper portions of the screen. This results in the slurry continuing to the bottom of the annulus before the gravel is separated from the liquid in the slurry. The separated liquid flows through the lower permeable screen and/or through perforations 15 thereby depositing the gravel at the bottom of the annulus. As the annulus 19 fills with gravel from the bottom up, the liquid in the slurry will continue to separate from the gravel and flow through the available perforations 15 in the casing and/or downward through the gravel which has already been deposited in annulus and through the lower permeable portions of screen 21.

The means for restricting flow through the upper portions of screen 21 may comprised any material which blocks or partially blocks fluid flow through the otherwise permeable wall of the screen. While in some completions this means can be left in place on the screen during production/injection, preferably, it is only temporary and is removable once the gravel pack has been completed so that flow is restored through all portions of screen 21. In the embodiment of FIG. 1, screen 21 of gravel pack apparatus 20 includes a flow-restrictive means 25 which comprises a sheath or sleeve 25 of a material which remains substantially solid during circulation of the gravel slurry but will "melt" or dissolve after the gravel has been placed throughout the completion interval of the annulus.

Examples of such materials which can be used as flow-restrictive means 25 include blends of waxes which melt at a desired temperature, e.g. if the desired melting point is to be substantially that of the temperature of formation 12 which, in turn, is 155°–160° F., the desired flow-restrictive sleeve can be made from material comprised of 90 percent by weight of a 138° F.

melting point paraffin wax and 10 percent of C-17 polyethylene. It should be understood that different waxes and additives can be blended together to provide materials having different melting temperatures for use in different completions and is well within the skill of the art. The sleeve 25 of wax can be molded and positioned along the upper portion of screen 21 or preferably, the wax is melted and poured onto the upper portion of the screen and allowed to cool to harden to form the sleeve, in situ.

In some instances, the flow-restrictive means may not be totally impermeable but may have small perforations, slits, or may be made in rings which are spaced slightly apart, etc. to allow some reduced flow during some stages of the completion operation just as long as the lower portion of the screen 21 provides the path of least resistance for the liquid flow from the gravel slurry during the initial gravel placement.

Other materials suitable for forming flow-restrictive means 25 include eutectic compounds formed by combining organic compounds, e.g. napthalene plus an organic additive, which yield a solid, hard, soap-like material but which will melt at designated temperatures, e.g. at or slightly above formation temperatures. For a further discussion of such compounds and typical compositions, see U.S. Pat. No. 3,768,563, which is incorporated herein by reference. Still other suitable materials include (1) salts which are soluble in particular solutions; and (2) asphaltenes which are soluble in crude oil.

Figure 2:
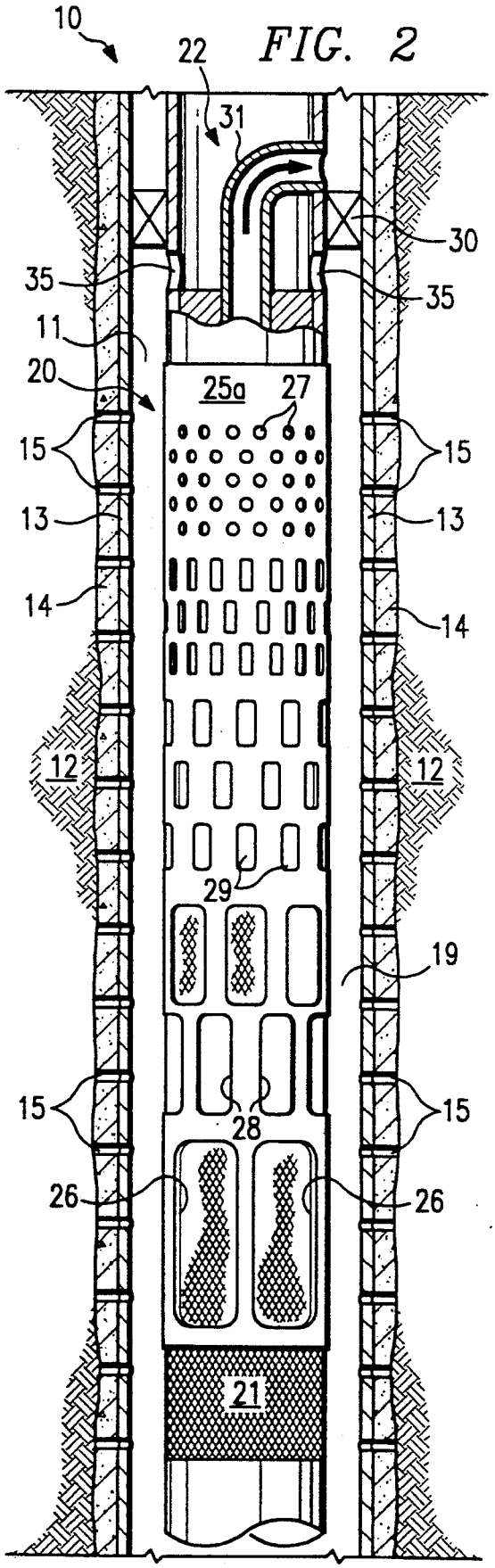
FIG. 2 is an elevational view, partly in section, of a further embodiment of the present gravel pack apparatus used in an operable position within a wellbore.

The flow-restrictive means may also be formed from a metallic materials, e.g. a soft or mild steel, which are dissolvable in acid solutions, e.g. hydrochloric acid. Since commercially-available screens 21 are routinely made of stainless steel, the acid will dissolve a sleeve made of mild steel but will not do any substantial damage to the screen. As illustrated in FIG. 2, flow-restrictive means 25*a* is comprised of a sleeve of mild steel which is positioned along screen 21 so that the lowermost portion 21*a* of the screen is preferably left uncovered. The sleeve is perforated along at least a portion of its length; that is, in some cases, the uppermost portion of the sleeve can be impermeable, i.e. "blanked".

Perforations 26 at the lower end of sleeve 25*a* are larger than perforations 27 at its upper end with intermediate sized perforations 28,29 in between. This allows substantially unrestricted flow through the uncovered end 21*a* and the larger perforations 26 in sleeve 25*a* while restricting flow through the smaller perforations and/or blanked portion adjacent the uppermost portions of the screen. As will be recognized that the sizes and the spacing of the various perforations shown in FIG. 2 are for illustrative purposes only and will likely vary for different particular completion operation. That is, there may be only two different sized perforations (no intermediate size perforations) or there may only be perforations at the bottom of the sleeve with a substantial length at the top of the sleeve being blanked, etc.. Again, the purpose of the flow-restrictive means is to establish the lower part of the screen as the path of least resistance to flow during the initial placement of the gravel in the annulus.

In operation, apparatus 20 having flow-restrictive means 25 in place on screen 21 is lowered into wellbore 11 on a workstring and is positioned adjacent formation 12. Packer 30 is set as will be understood by those skilled in the art. Gravel slurry is then pumped down the workstring and out the outlet ports 35 in cross-over sub 22 to flow downward in the annulus 19. Means 25 restricts the flow of liquid from the slurry into the upper portion of screen 21 so that there is little, if any, premature liquid loss to the upper portions of the screen, thereby significantly reducing the possibility of sand bridges being formed in the annulus before the gravel pack is completed.

By restricting fluid flow into the top of the screen, the slurry will carry the gravel to the bottom of the completion interval before any substantial amounts of liquid is lost from the slurry. The separated liquid flows through the permeable bottom of the screen 21 and is returned to the surface through pipe 31 in cross-over 22 and the well annulus (not shown) above packer 30. The gravel carried by the slurry is deposited and builds up around screen 21 from the bottom to the top of the completion interval to complete the gravel pack.

After the gravel has been deposited around screen 21, flow-restrictive means 25 can be removed to re-establish fluid flow through the length of screen 21. If means 25 is comprised of wax or some other material which will melt at the formation temperature, the material will melt by itself and can be removed from screen 21 by production or injection fluids. If these materials are designed to melt at temperatures greater than the formation temperature, a heated fluid can be circulated through the well to melt and remove means 25. If means 25 is comprised of a salt, an asphaltene, a metal (e.g. sleeve 25*a*) or some other material which is dissolvable in a particular solution, that particular solution is circulated to remove means 25.

What is claimed is:

1. A method for gravel packing an interval of a wellbore, said method comprising:

positioning a permeable screen within the wellbore adjacent said integral to form an annulus between said screen and said wellbore;

flowing a gravel slurry down said wellbore and into said annulus around said screen; and restricting the flow of fluid from said annulus into the upper portions of said screen while allowing substantially unrestricted flow through the lower portions of said screen while said gravel slurry is flowing through the annulus.

2. A method for gravel packing an interval of a wellbore, said method comprising:

positioning a permeable screen within the wellbore adjacent said interval to form an annulus between said screen and said wellbore;

flowing a gravel slurry down said wellbore and into said annulus around said screen to deposit gravel in said annulus around said screen; and providing a flow-restrictive means along the upper portion of said screen to restrict fluid flow from the annulus into said screen while allowing substantially unrestricted flow through the lower portions of said screen while said gravel slurry is flowing through said annulus.

3. The method of claim 2 including:

removing said flow-restrictive means after said gravel has been deposited in said annulus to allow unrestricted flow into all portions of said screen.

4. The method of claim 3 wherein said flow-restrictive means is comprised of a material which melts at a designed temperature; and said flow-restrictive means is removed by flowing a fluid having a temperature at or above said designed temperature through said annulus.

5. The method of claim 4 wherein said material is comprised of wax.

6. The method of claim 3 wherein said flow-restrictive means is comprised of a dissolvable material; and said flow-restrictive means is removed by flowing a fluid which will dissolve said dissolvable material through said annulus.

7. The method of claim 6 wherein said dissolvable material is comprised of metal; and said flow-restrictive means is removed by flowing an acid through said annulus.

8. Apparatus for gravel packing an interval of a wellbore, said apparatus comprising:

a screen adapted to be connected to the lower end of a workstring; and flow-restrictive means along the upper portion of said screen to restrict fluid flow into said upper portion of said screen, said flow-restricting means comprising:

a sleeve of material positioned along at least the upper portion of said screen, said sleeve having perforations substantially throughout its length, said perforations in the lower portion of said sleeve being substantially larger than the perforations in the upper portion of said sleeve.

* * * * *